United States Patent [19]

Cromer et al.

[11] 4,112,276

[45] Sep. 5, 1978

[54] COMPRESSED-GAS CIRCUIT-INTERRUPTER HAVING A SLEEVE-VALVE FOR TEMPORARILY BLOCKING THE ORIFICE THROAT

[75] Inventors: Charles F. Cromer, Level Green-Penn Township, Allegheny County; Kue H. Yoon, Pittsburgh; Willie B. Freeman, Monroeville, all of Pa.

[73] Assignee: Westinghouse Electric Corp., Pittsburgh, Pa.

[21] Appl. No.: 727,510

[22] Filed: Sep. 28, 1976

[51] Int. Cl.[2] ..... H01H 33/88

[52] U.S. Cl. ..... 200/148 R; 200/148 A

[58] Field of Search ..... 200/148 A, 150 G, 148 R, 200/148 B

[56] References Cited

U.S. PATENT DOCUMENTS

| | | | |
|---|---|---|---|
| 2,933,575 | 4/1960 | Baker | 200/148 A |
| 3,786,215 | 1/1974 | Mauthe | 200/148 A |
| 3,941,962 | 3/1976 | Thaler | 200/148 A |
| 3,955,057 | 5/1976 | Dabringhausen et al. | 200/148 A |

FOREIGN PATENT DOCUMENTS

| | | | |
|---|---|---|---|
| 2,273,362 | 12/1975 | France | 200/148 A |

*Primary Examiner*—Robert S. Macon

*Attorney, Agent, or Firm*—W. R. Crout

[57] ABSTRACT

An improved compressed-gas-type of circuit-interrupter is provided having a pair of separable contacts and a cooperating nozzle structure, through which the established arc is drawn. A spring-biased sleeve-valve surrounds at least one of these separable contacts, and extends at times into the orifice throat in the closed-circuit position of the device, and also during a portion of the opening operation, thereby blocking any gas flow through the throat of the orifice device in such blocking position of the sleeve-valve.

The aforesaid sleeve-valve is preferably attached by a lost-motion mechanical connection with the associated captive contact, which it surrounds, so that during an intermediate portion of the opening operation, the sleeve-valve is physically picked up on the opening stroke by the aforesaid captive contact, or, alternatively, limited in its blocking action, and withdrawn out of the orifice throat upon take-up of the lost motion, thereby unblocking the said throat and thus permitting a flow of gas therethrough.

13 Claims, 9 Drawing Figures

CLOSED POSITION

LAST CONTACT ENGAGEMENT

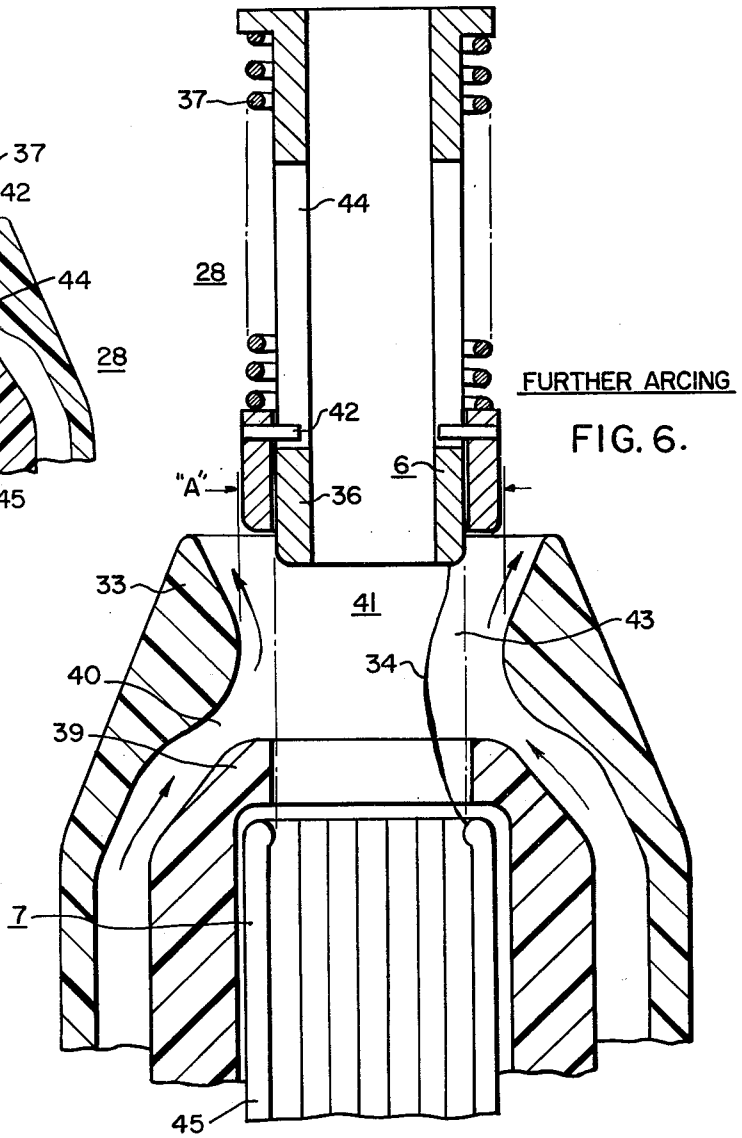
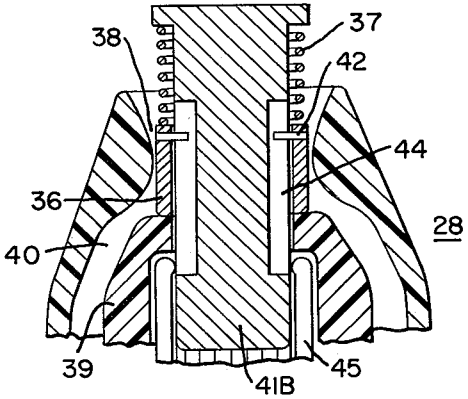
FIG. 9.
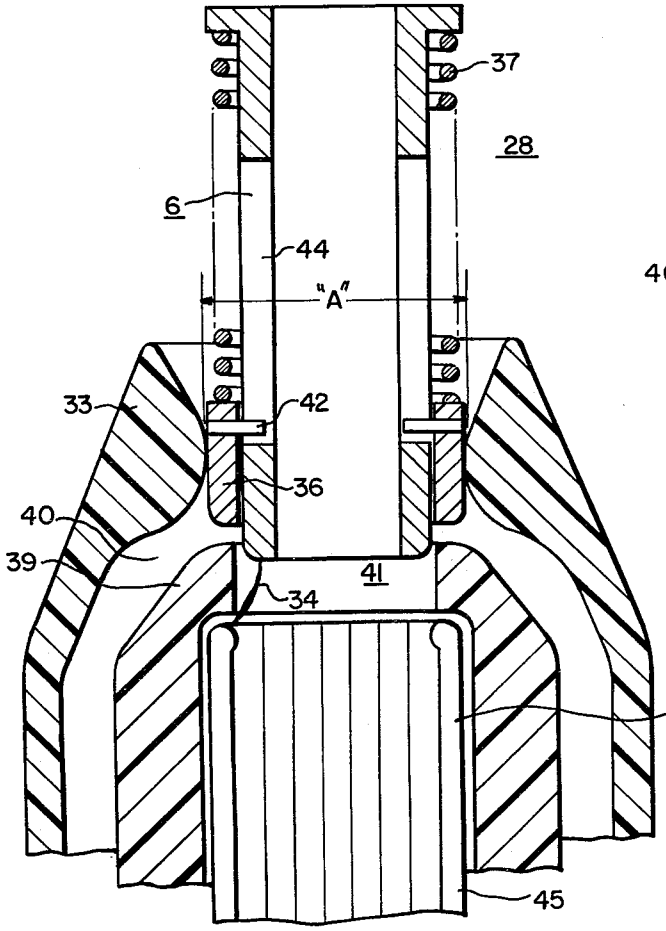

COMPRESSED-GAS CIRCUIT-INTERRUPTER HAVING A SLEEVE-VALVE FOR TEMPORARILY BLOCKING THE ORIFICE THROAT

CROSS-REFERENCES TO RELATED APPLICATIONS

Reference may be made to U.S. patent application filed Dec. 31, 1975, Ser. No. 645,753 by T. E. Alverson et al., entitled "Circuit Breaker"; and U.S. Pat. patent application filed Dec. 31, 1975, Ser. No. 645,867 by Russel N. Yeckley et al., entitled "Circuit Breaker"; and U.S. patent application filed Dec. 31, 1975, Ser. No. 645,867; U.S. patent application filed Mar. 21, 1975, Ser. No. 560,461 by Joseph R. Rostron, entitled "Double-Puffer-Type Compressed-Gas Circuit-Interrupter Constructions"; U.S. patent application filed May 12, 1975, Ser. No. 576,820, now U.S. Pat. No. 3,987,262, issued Oct. 19, 1976 to Joseph R. Rostron. Other applications, which may be referred to, are U.S. patent application filed May 12, 1975, Ser. No. 576,820, by Joseph Rostron; U.S. patent application filed Aug. 7, 1975, Ser. No. 602,705, by Cromer et al.; U.S. patent application filed Sept. 25, 1975, Ser. No. 616,703, by Rostron et al.; U.S. patent application filed Mar. 11, 1976, Ser. No. 665,823 by Charles F. Cromer et al.; U.S. patent application filed Sept. 21, 1976, Ser. No. 725,313 by Charles F. Cromer et al., all of said patent applications being assigned to the assignee of the instant patent application. Reference may also be made to U.S. patent application filed Dec. 31, 1975, Ser. No. 645,752 by Cromer et al., entitled "Improved Double-Flow Puffer-Type Single-Pressure Compressed-Gas Circuit-Interrupter".

SUMMARY OF THE INVENTION

An improved compressed-gas-type of circuit-interrupter is provided having separable contacts and a cooperable orifice structure, through which compressed gas is forced during the opening operation of the interrupter to effect thereby an intimate engagement with the established arc, the latter, of course, being drawn through the said hollow orifice structure. Associated with one of the separable contacts is a spring-biased sleeve-valve having a lost-motion mechanical connection with one of the contacts, so that in the closed-circuit position of the device, the aforesaid spring-biased sleeve-valve is situated in a blocking relationship with the throat of the aforesaid nozzle structure. This prevents compressed gas flow therethrough, not only in the closed-circuit position of the device, but also during the initial portion of the opening operation, due to the provision of the lost-motion mechanical connection of the sleeve-valve with the captive encircled contact.

Following a predetermined opening travel of the captive contact, the sleeve-valve is picked up by the captive contact, or, alternatively, limited in its following action with the movable contact structure and removed from the blocking throat location, thereby unblocking or freeing the said orifice structure and thus permitting gas flow therethrough to effect circuit interruption.

In one embodiment, the sleeve-valve is associated with the stationary contact of the device, which is preferably tubular. In another embodiment of the device, the sleeve-valve is associated with the movable contact rod, which preferably is vented.

BRIEF DESCRIPTION OF THE DRAWINGS

FIG. 5 is a fragmentary view illustrating arc establishment and continued contacting blocking operation;

FIG. 6 illustrates further arc lengthening and unblocking action of the sleeve-valve out of the throat of the nozzle structure;

DESCRIPTION OF THE PREFERRED EMBODIMENTS

Figures 1, 2:
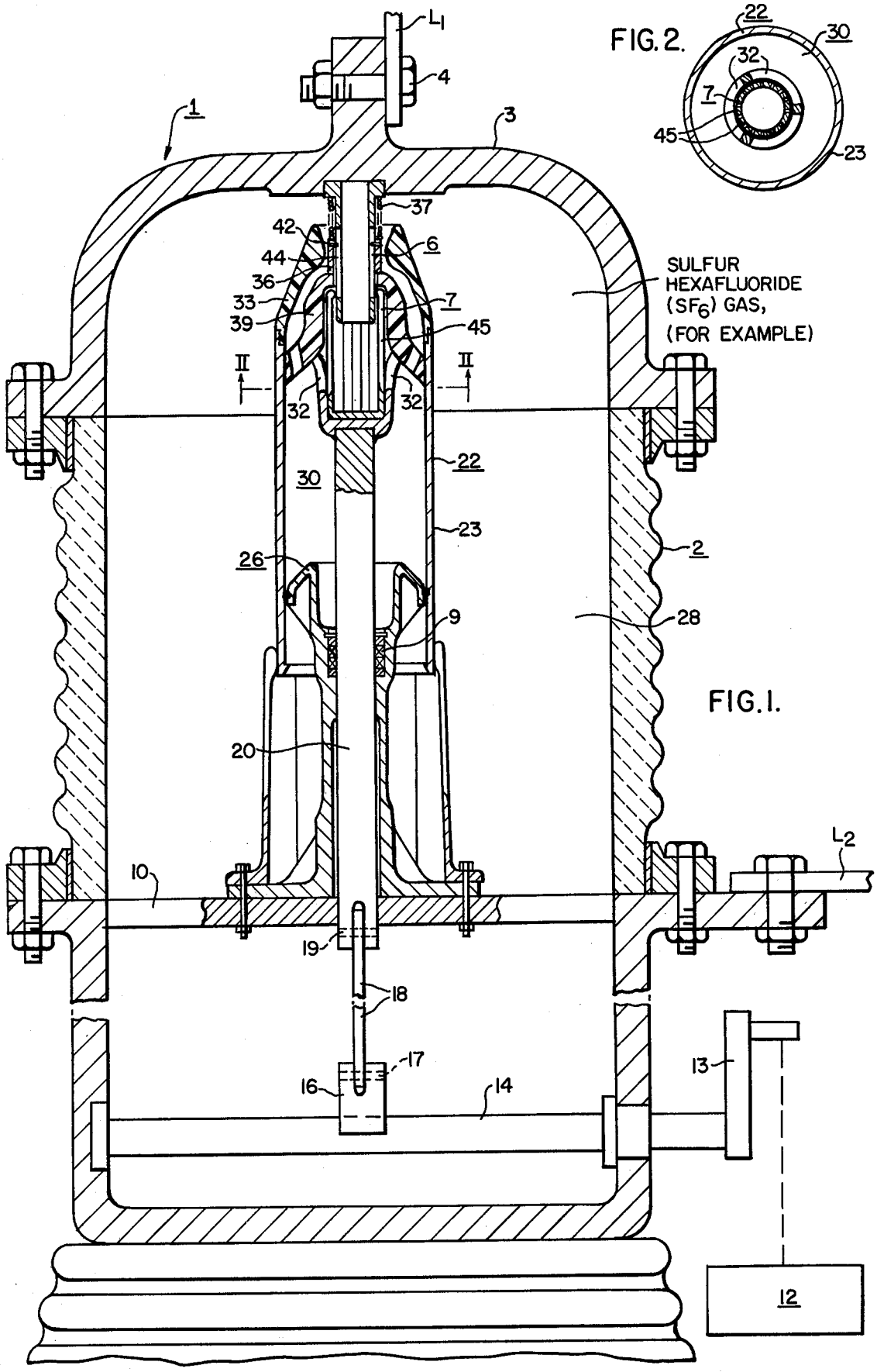
FIG. 1 is a vertical sectional view taken through one embodiment of the present invention, illustrating a gas-blast, puffer-type, circuit-interrupter with the separable contacts illustrated in the closed-circuit position.
FIG. 2 is a detailed sectional view taken substantially along the line II—II of FIG. 1 looking in the direction of the arrows.

Referring to the drawings, and more particularly to FIGS. 1–4 thereof, it will be observed that there is provided a puffer-type compressed-gas circuit-interrupter 1 having an upstanding insulating casing structure 2, which is provided at its upper end with a metallic dome-shaped conducting cap portion 3, the latter supporting, by means of a bolt 4, a line-terminal connection $L_1$. Extending downwardly interiorly of the conducting dome-shaped casting 3 within the casing 2 is a relatively-stationary contact structure, designated by the reference numeral 6, and cooperable in the closed-circuit position with a movable contact structure 7, as illustrated more clearly in FIG. 1 of the drawings. The movable contact structure 7 is electrically connected, by a plurality of sliding ring contacts 9, to a generally-horizontally-extending conducting support plate 10, which provides a second line terminal $L_2$ disposed externally of the casing 2, as again shown more clearly in FIG. 1.

A suitable operating mechanism 12 of conventional form effects rotation of an externally-provided crank-arm 13, the latter effecting opening and closing rotative motions of an internally-disposed operating shaft 14. The operating shaft 14, in turn, is fixedly connected to an internally-disposed rotative crank-arm 16, which is pivotally connected, as at 17, to a floating link 18, the latter being pivotally connected, as at 19, to the lower end of a linearly-movable contact operating rod 20.

It will be noted that the upper end of the contact operating rod 20 forms the movable contact 7 itself, which, as mentioned heretofore, makes contacting closed-circuit engagement with the stationary contact structure 6 in the closed-circuit position of the interrupting device 1, as illustrated in FIG. 1.

A movable operating cylinder assembly 22 is provided having a large-diameter, downwardly-extending movable sleeve portion 23, which slidably moves over a relatively-fixed piston structure 26, as again illustrated in FIG. 1.

Figure 3:
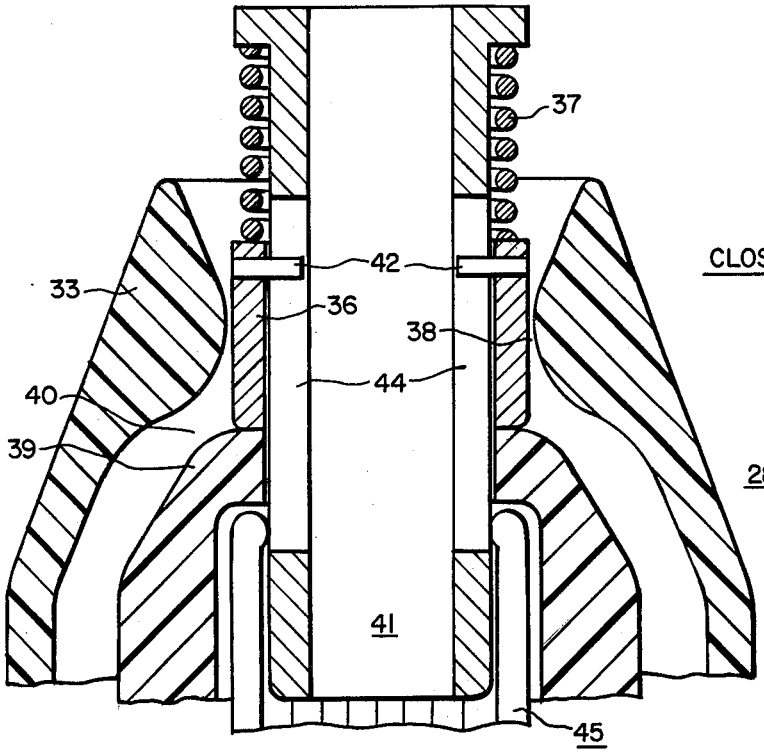
FIG. 3 is a considerably-enlarged, fragmentary, view illustrating the closed-circuit position of the device, with the sleeve-valve shown in its blocking location.
Figure 4:
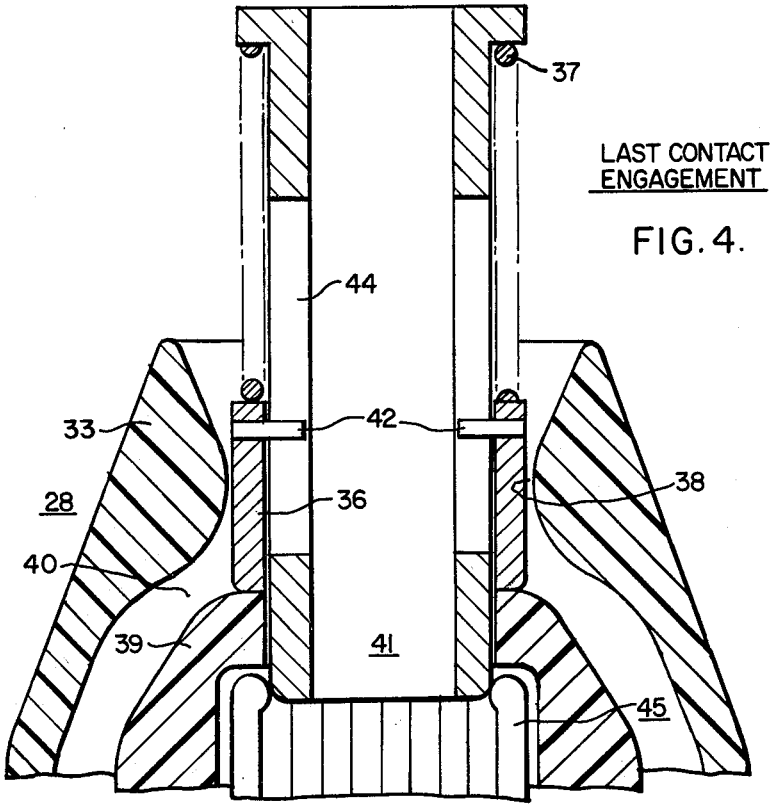
FIG. 4 is a fragmentary view, somewhat similar to that of FIG. 1, but illustrating the position of the several parts at the last point of contacting engagement of the interrupter.

During the opening operation, it will be observed that the movable operating cylinder 22 moves downwardly over the relatively-fixed piston structure 26 compressing gas 28 within the region 30, and forcing it to flow upwardly through the vent openings 32 and through the relatively short nozzle 33, through which the arc 34 is drawn, as shown in FIGS. 3 and 4.

As shown in FIGS. 3 and 4, it will be observed that during the initial portion of the opening operation, and while the established arc 34 is of an insufficient length for interruption, a sleeve-valve 36 blocks the throat 38 of the orifice structure 33, and thereby prevents gas 28 exiting, or exhausting from the nozzle structure 33. This advantageously prevents contamination of the cool gas in the location 40 from being contaminated by the hot ionized products of the decomposition of the established arc 34 at a point in time when it is impossible to effect arc extinction, due to the short length of the established arc 34 and the line voltage encountered.

At a later point of time in the opening operation, as illustrated in FIG. 6, here the arc 34 is of sufficient length to be interrupted, and at this desirable time, the sleeve-valve 36 is forced to its extended position, as illustrated in FIG. 6, with the movable orifice structure 33 moving below the sleeve-valve 36, thereby permitting an unblocking or freeing action to ensue.

It will be observed that by the utilization of the sleeve-valve 36, associated with the stationary contact structure 6, there exists the advantage of preventing contamination of the cooled gas 28 at a point of time in which the use of such gas 28 would be ineffective due to the short length of the arc 34 and the impressed line voltage.

With the aforesaid construction, it will be apparent that there is a reduction of the minimum arcing time, providing for higher interrupting current capability of the device 1, and the construction provides a desirable relief-valve for pre-interruption of the arcing products at a point in time when the sleeve-valve 36 blocks, and thereby retains the cool gas in the location 40, thereby effecting a desirable segregation of the gas volumes 40, 41.

The slider 36 allows the nozzle throat area 43 to be enlarged and prevents $SF_6$ gas leakage through this increased area until a predetermined travel. At this travel point, the slider 36 opens the enlarged nozzle area, and thus provides the increased $SF_6$ gas flow rate necessary to reduce the minimum arcing time.

In addition, the slider 36 can be adjusted to act as a relief-valve for pre-interruption arc products. This is accomplished by setting the bias spring load 37 to the pressure force generated by the pre-interruption arcing. The arc-generated force will push the slider 36 outside the nozzle 33, and allow these products to clear before the stationary contact 6 is removed from the nozzle throat 43.

The fixed contact assembly consists essentially of the stationary contact 6, sliding follower 36 and follower biasing spring 37. The moving contact assembly 7 consists of a finger contact assembly 45, flow director and shield 39 and nozzle 33.

In the closed-position, as shown in FIG. 1, the sliding follower 36 engages the flow director 39 and compresses the biasing spring 37.

As the moving contact 7 starts to open, the force exerted by the biasing spring 37 maintains the sliding follower 36 in contact with the flow director 39, thus preventing premature loss of gas through the otherwise annular area surrounding the stationary contact 6. When the pins 42 reach the end of the restraining slots 44, further motion of the moving contact assembly 7 opens the large nozzle area 43 of nozzle 33.

The adaptation of the sliding follower 36 allows the nozzle throat area "A" to be enlarged without expanding or enlarging the finger contact 45 and flow director 39. It further prevents gas leakage until a predetermined travel of the moving contact assembly 7. At this travel point the sliding follower 36 opens the enlarged nozzle area "A", and thus provides for the larger volume flow of gas with a more rapid clearing of arc products and a subsequent reduction in arcing times at the higher current values.

Figure 8:
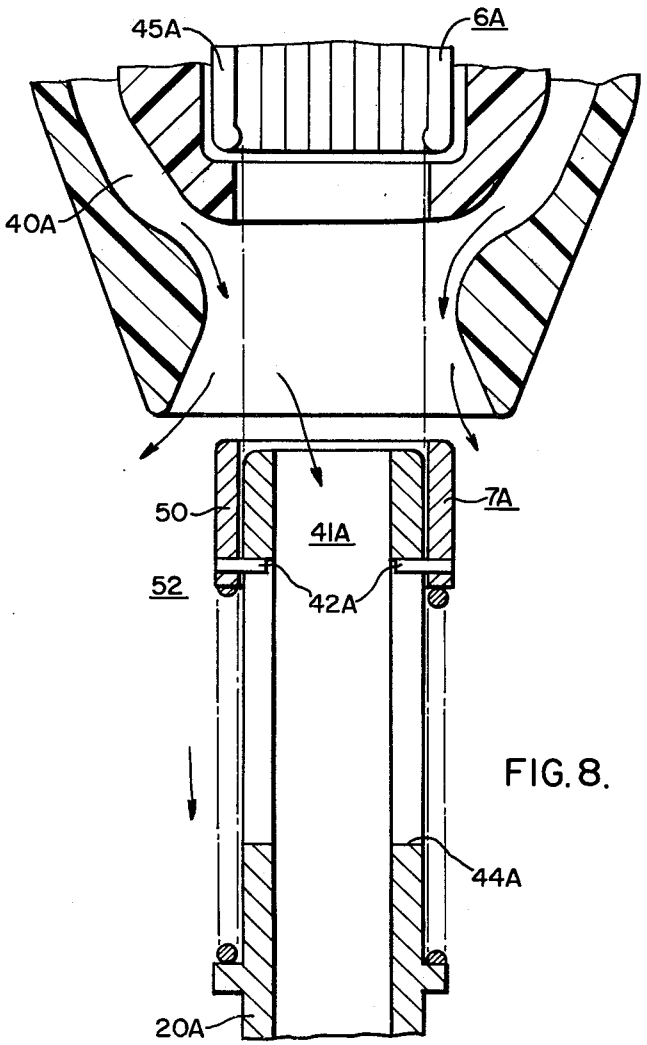
FIG. 8 is a fragmentary view illustrating the fully-open-circuit position of the modification illustrated in FIG. 7, showing a later arc-extinction stage in the opening operation of the device; and, FIG. 9 illustrates a further modification of the invention.
Figure 7:
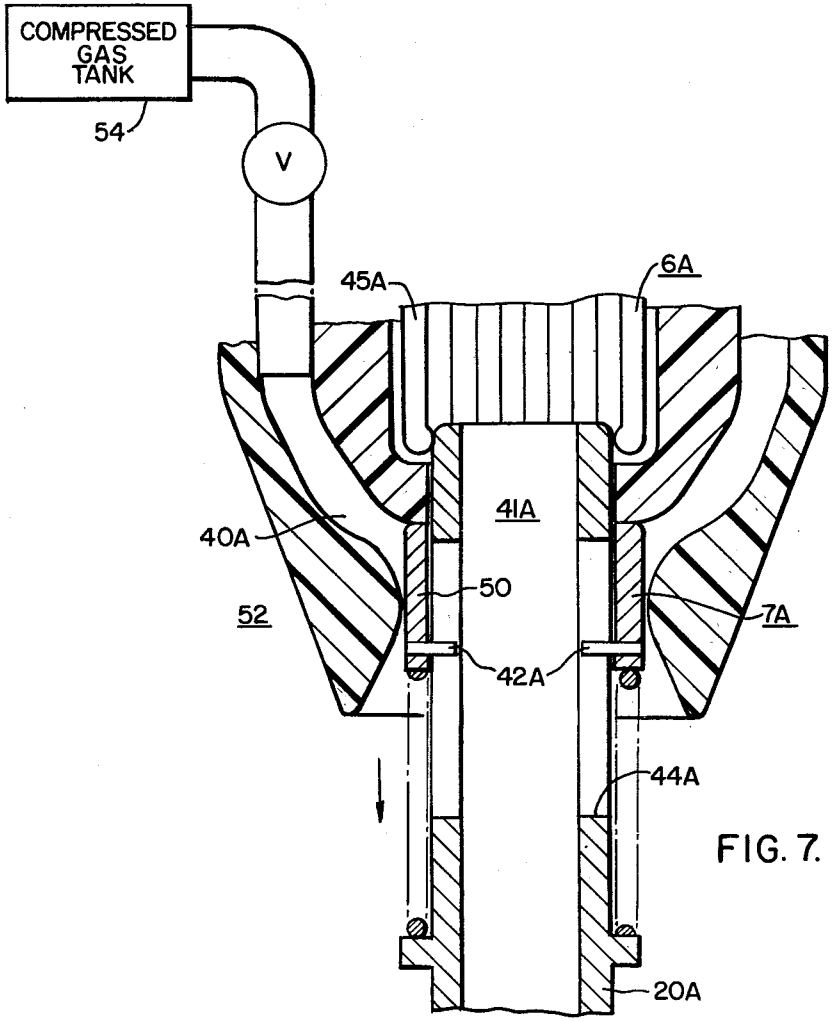
FIG. 7 illustrates an alternate embodiment of the device, in which the sleeve-valve is associated with the movable contact rod, and, alternatively, an externally-provided compressed-gas source is utilized, instead of a piston-and-cylinder arrangement.

FIGS. 7 and 8 illustrate an alternate construction, in which the sleeve-valve 50 is associated with the movable contact rod 20A of the device 52. The action is the same as heretofore described in connection with FIGS. 1–6, and will, consequently, not be repeated in detail. It will, however, be noted that a separate externally-provided source of compressed gas 54 is utilized, instead of the piston-and-cylinder arrangement 22, 26 of FIGS. 1–6.

It is also to be understood that instead of both contacts 6, 7 being vented, and allowing gas flow therethrough, for certain applications, particularly for lower-current capabilities, or for other reasons, the one or both contacts 6, 7 may be solid, as shown in FIG. 9, that is, unvented, where such a structure is desired. However, as well understood by those skilled in the art, for the higher-current ratings, venting action through both separable contacts 6, 7 is desirable to lead to a desired rapid exhausting of preinterruption products during sleeve-blocking action, as heretofore described.

Although there has been illustrated and described specific structures, it is to be clearly understood that the same were merely for the purpose of illustration, and that changes and modifications may readily be made therein by those skilled in the art, without departing from the spirit and scope of this invention.

We claim:

1. A compressed-gas circuit-interrupter including a pair of separable contacts separable to establish an arc during the opening operation of the circuit-interrupter, means defining a hollow insulating orifice structure having an inner throat portion through which said established arc is drawn, a sleeve-valve surrounding one of said separable contacts rendering it captive and having a lost-motion mechanical connection therewith, means biasing said sleeve-valve to an extended position relative to said captive contact wherein it, together with its inner-disposed captive contact, substantially blocks the flow of compressed gas through said throat portion in the closed-circuit position of the device, at least one of said separable contacts being vented so that hot, ionized, products of decomposition may exhaust therethrough during the initial stage of arcing and also during the time of valve-blocking action, while the sleeve-valve blocks the said orifice throat portion, and the said captive contact picking up the sleeve-valve following take-up of the said lost-motion connection, so that unblocking action occurs at the throat portion at a time of substantial arc length and also at a time when arc extinction is possible.

2. The combination according to claim 1, wherein the lost-motion connection between the sleeve-valve and its captive contact includes at least one slot provided in the side wall of the captive contact, and a compression spring encircling the said captive contact having one end thereof bearing upon the sleeve-valve to its extended position.

3. The combination according to claim 1, wherein both separable contacts are vented to enable hot, ionized, gas to flow therethrough during the blocking action of the sleeve-valve.

4. The combination according to claim 1, wherein the sleeve-valve surrounds the relatively-stationary contact.

5. The combination according to claim 1, wherein the sleeve-valve surrounds the relatively-movable contact.

6. The combination according to claim 1, wherein a movable operating cylinder is utilized sliding over a relatively-stationary piston structure carrying therewith the said insulating orifice structure, and the said sleeve-valve encompasses the relatively-stationary contact.

7. The combination according to claim 4, wherein the said relatively-stationary contact is vented.

8. The combination according to claim 1, wherein the insulating orifice structure is fixed, the sleeve-valve surrounds the movable contact, and the relatively-movable contact is vented so that hot, ionized, arc gases may exhaust therethrough during the blocking action of the sleeve-valve.

9. The combination according to claim 8, wherein an auxiliary compressed-gas reservoir-tank is supplied, and compressed gas is utilized from this compressed-gas reservoir-tank during the opening operation of the circuit-interrupter.

10. A compressed-gas circuit-interrupter including a pair of separable contacts separable to establish an arc during the opening operation of the circuit-interrupter, means defining a double-orifice, hollow, insulating orifice structure, one of said separable contacts being disposed inwardly of the inner orifice member, the other of said separable contacts extending through both orifice openings of the double-orifice structure, a sleeve-valve surrounding said latter-mentioned separable contact, and having a lost-motion mechanical connection therewith, means biasing said sleeve-valve to an extended position relative to said captive contact wherein it, together with its inner-disposed captive contact, substantially blocks the flow of compressed gas through said double-orifice structure in the closed-circuit position of the device, said sleeve-valve abutting the inner orifice member of said double-orifice insulating structure in the closed-circuit position of the device, the captive contact being vented so as to exhaust hot, ionized, products of decomposition through the said captive contact during the initial portion of the opening operation, when the sleeve-valve is in its extended, blocking, position within the throat-portion of the outer orifice member, and said captive contact picking up the sleeve-valve during the opening operation to effect unblocking action thereof at a point in time in which the arc length is sufficiently adequate to enable arc extinction to ensue.

11. The combination according to claim 10, wherein the double-orifice structure is movable, an operating cylinder is provided carrying the said movable double-orifice structure, a relatively-fixed piston is provided, over which the said movable operating cylinder slides to compress gas therebetween, and the first-mentioned, shrouded, contact also being movable and carried by the said movable operating cylinder.

12. The combination according to claim 10, wherein both separable contact structures are vented to enable rapid venting of the hot, ionized, arcing products.

13. A compressed-gas circuit-interrupter including a pair of separable contacts separable to establish an arc during the opening operation of the circuit-interrupter, means defining a hollow insulating orifice structure having an inner throat portion through which said established arc is drawn, a sleeve-valve surrounding one of the said separable contacts rendering it captive and having a lost-motion mechanical connection therewith, means biasing said sleeve-valve to an extended position relative to said captive contact wherein it, together with its inner-disposed captive contact, substantially blocks the flow of compressed gas through said throat portion in the closed-circuit position of the device, and the said captive contact picking up the sleeve-valve following take-up of the said lost-motion connection, so that unblocking action occurs at the throat portion at a time of substantial arc length and also at a time when arc extinction is possible.

* * * * *